US006220495B1

(12) United States Patent
Jakob

(10) Patent No.: US 6,220,495 B1
(45) Date of Patent: Apr. 24, 2001

(54) BOLT SETTING TOOL FOR DRIVING BOLTS OR THE LIKE INTO CONSTRUCTIONAL COMPONENTS

(75) Inventor: Robert Jakob, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/670,139

(22) Filed: Sep. 26, 2000

(30) Foreign Application Priority Data

Oct. 2, 1999 (DE) ..... 199 47 464

(51) Int. Cl.[7] ..... B25C 1/14
(52) U.S. Cl. ..... 227/10
(58) Field of Search ..... 227/9, 10, 11, 227/130; 173/210, 211

(56) References Cited

U.S. PATENT DOCUMENTS 3,115,639 * 12/1963 Elliott ..... 227/10
3,465,942 * 9/1969 Diehl ..... 227/10
3,632,032 * 1/1972 Termet ..... 227/10
4,122,987 * 10/1978 Jochum et al. ..... 227/10
4,134,527 * 1/1979 Termet ..... 227/10
4,405,072 * 9/1983 Kindle et al. ..... 227/10
4,824,003 * 4/1989 Almeras et al. ..... 227/10
5,056,701 * 10/1991 Bereiter ..... 227/10

* cited by examiner

*Primary Examiner*—Scott A. Smith
(74) *Attorney, Agent, or Firm*—Brown & Wood, LLP

(57) ABSTRACT

A bolt setting tool including a bolt guide (5), an axially displaceable drive piston (g) a sleeve-shaped pressure member (7) arranged between the head (92) of the drive piston (9) and the bolt guide (5) and having a cylindrical extension (8) extending in a setting direction (S) and projecting into the receiving chamber (6) of the bolt guide (5), with the cylindrical extension (8) having a smaller diameter than a remainder of the pressure member (7), an elastic pad (10) mounted on the cylindrical extension (8) of the pressure member (7) between two seal rings, with the first seal ring (13) being arranged between a ring-shaped stop surface (71) of the pressure member (7) and an end surface (11) of the pad (10) facing in a direction opposite to the setting direction and being radially resiliently preloaded against an inner wall of the receiving chamber (6) of the bolt guide (5), and with the second seal ring (14) being arranged between a ring-shaped stop surface (61) formed in the receiving chamber (6) and an end surface (12) of the pad (10) facing in the setting direction (S) and being radially resiliently preloaded against an outer surface of the cylindrical extension (8) of the pressure member (7).

7 Claims, 2 Drawing Sheets

BOLT SETTING TOOL FOR DRIVING BOLTS OR THE LIKE INTO CONSTRUCTIONAL COMPONENTS

BACKGROUND OF THE INVENTION

1. Field of the Invention

The present invention relates to a bolt setting tool for driving bolts and similar fastening elements into constructional components and including a bolt guide having a receiving chamber, an axially displaceable drive piston having a head, a sleeve-shaped pressure member arranged between the head of the drive piston and the bolt guide and having a cylindrical extension extending in a setting direction and projecting into the receiving chamber of the bolt guide, with the cylindrical extension having a smaller diameter than a remainder of the pressure member and an elastic pad mounted on the cylindrical extension of the pressure member.

2. Description of the Prior Art

There exists a number of different bolt setting tools for driving bolts or the like into constructional components and including a reciprocating drive piston. The energy for effecting the drive-in can be obtained, e.g., from explosive powder charge-containing cartridges. The primary energy of the ignited cartridge is transformed into the kinetic energy of the drive piston which drives a bolt or the like into a constructional component. With only a partial use of the kinetic energy of the drive piston, the excess energy must be absorbed without any damage to the movable parts of the tool. Because, as is known, the constructional components have very different consistencies or rigidity properties, the bolt setting tool should be designed with a relatively high reserve of excess energy. The components of the setting tool, which cooperate with the drive piston, can be seriously damaged as a result of being subjected to a high energy impact by the drive piston. That would require their replacement, resulting in additional expenses and an increased idling time.

There essentially exist two possibilities to deal with an excess energy in bolt setting tools equipped with a drive piston. In the first case, the excess energy is dissipated outside of the setting tool. To this end, the tool is so designed that the drive piston exits the mouth of the tool and becomes operatively connected with a constructional component into which a bolt or other fastening element is being driven in. With a normal rigidity of the constructional component, the excess energy is dissipated as a result of partial penetration of the drive piston in the constructional component or a constructional part. Thus, the drive piston performs a deformation work outside of the setting tool. With these constructive measures, the run-on shoulders or the like inside the tool are loaded to a small extent only. However, with these constructive measures, the bolt setting tool looses its advantage of achieving a uniform penetration depth of the bolts independently from the rigidity characteristics of a constructional part or component. Rather, the opposite is the case. The penetration depth of the bolt would vary dependent on the rigidity of the components. With a weak constructional part, this can result in a driven-in bolt emerging form the rear side of the constructional part.

In the second type of the setting tools, the excess energy is absorbed or dissipated between the elements of the setting tool itself. The absorption of the excess energy is achieved by providing plastically or elastically deformable parts between two, movable relative to each other, tool elements. Thus, German Publication DE-A-1 478 838 discloses a bolt setting tool in which a sleeve-shaped pressure member, which is operatively connectable with the drive piston, and an excess energy-absorbing pad are arranged between the drive piston and the bolt guide. The pad is mounted on a smaller diameter extension of the stepped pressure member and is supported against a shoulder of the pressure member facing in the setting direction and an annular matching surface of the bolt guide facing in a direction opposite the setting direction. Because the pressure member is displaceable relative to the bolt guide, a relatively large clearance is provided between the two parts. As a result, on opposite sides of the pad, annular clearances or gaps are present between the pressure member and the bolt guide. Upon compression of the pad, it can wedge between the inner wall of the bolt guide and the outer wall of the pressure member. This can result in jamming of the movable parts which may cause a breakdown of the tool.

Accordingly, an object of the present invention is to provide a bolt setting tool in which the excess energy is absorbed within the tool and in which jamming of the movable parts is reliably prevented.

Another object of the present invention is to provide a bolt setting tool in which the possibility of jamming of movable parts is eliminated and the constructive elements have a simple structure and can be easily mounted in the tool.

A further object of the present invention is to provide jamming preventing means which can easily be installed in the existing setting tools.

SUMMARY OF THE INVENTION

These and other objects of the present invention, which will become apparent hereinafter, are achieved by providing a bolt setting tool for driving bolts and the like into constructional components and including a bolt guide, an axially displaceable drive piston, and a sleeve-shaped pressure member arranged between the drive piston, and the bolt guide. The pressure member has a cylindrical extension extending in a setting direction and projecting into the receiving chamber of the bolt guide with the cylindrical extension having a smaller diameter than a remainder of the pressure member, and with an elastic pad mounted on the cylindrical extension between two seal rings. The first seal ring is arranged between a ring-shaped stop surface of the pressure member and an end surface of the pad facing in a direction opposite to the setting direction and is radially resiliently preloaded against an inner wall of the receiving chamber of the bolt guide. The second seal ring is arranged between a ring-shaped stop surface formed in the receiving chamber of the bolt guide and an end surface of the pad facing in the setting direction and is radially resiliently preloaded against an outer surface of the cylindrical extension of the pressure member.

As discussed above, the setting tool has relatively large annular gaps between the movable parts. However, the seal rings, which are provided on opposite sides of the pad, prevent wedging of the pad between the pressure member and the inner wall of the receiving chamber and between the cylindrical extension of the pressure member and the inner wall of the bolt guide. Because the first seal ring, which is arranged between the ring-shaped stop surface of the pressure member and an end surface of the pad facing in a direction, is radially resiliently preloaded against the inner wall of the receiving chamber of the bolt guide, the first seal ring closes the clearance between the pressure member and the inner wall of the receiving chamber of the bolt guide. The second seal ring, which is arranged between a ring-shaped stop surface of the receiving chamber and an end surface of the pad facing in the setting direction and which is resiliently radially preloaded against an outer surface of the cylindrical extension of the pressure member, closes the annular gap between the outer surface of the cylindrical extension and the inner surface of the bolt guide. The high inner pressures, which are generated during the tool operation, reinforce the radial sealing forces which press the outer surface of the first seal ring against the inner wall of the receiving chamber and the inner surface of the second seal ring against the outer surface of the cylindrical extension of the pressure member. Thus, the two seal rings prevent jamming of movable relative to each other part and prevent, in particular, wedging and damage of the pad. The seal rings have a simple construction and can easily be installed in the existing bolt setting tools.

For effecting the necessary compensation of existing axial tolerances the seal rings are advantageously formed of a plurality of disc-shaped sealing rings with outer or inner preloading. This enables, in particular during the retooling of the existing setting tools, to adapt them to existing constructive conditions and to provide for the compensation of axial gaps.

The seal rings need be formed of a material capable of withstanding inner pressures and temperatures generated during operation and capable of providing the necessary radial outer and inner preloading. Advantageously, the seal rings are produced of a spring steel which insures their simple and cost-effective manufacture.

To prevent the loss of the rings during necessary periodical cleaning of the setting tool components, the seal rings are advantageously fastened to the stop surfaces of the pressure member and the bolt guide or to the pad end surfaces.

For manufacturing and maintenance reasons, the pad is advantageously formed as a one-piece sleeve member having, at least region wise, an outer diameter which is smaller than the inner diameter of the receiving chamber of the bolt guide. Thereby, during compression, the pad can expand radially in order to absorb the excess energy.

In particular in connection with forming the pad as a one-piece part, it is advantageous when the seal rings are fixedly attached to the end surfaces of the pad, e.g., by gluing or vulcanization. In this case, the pad and the seal rings form an integral part which can be easily mounted and properly positioned.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiment, when read with reference to the accompanying drawing.

DETAILED DESCRIPTION OF THE PREFERRED EMBODIMENT

Figure 1:
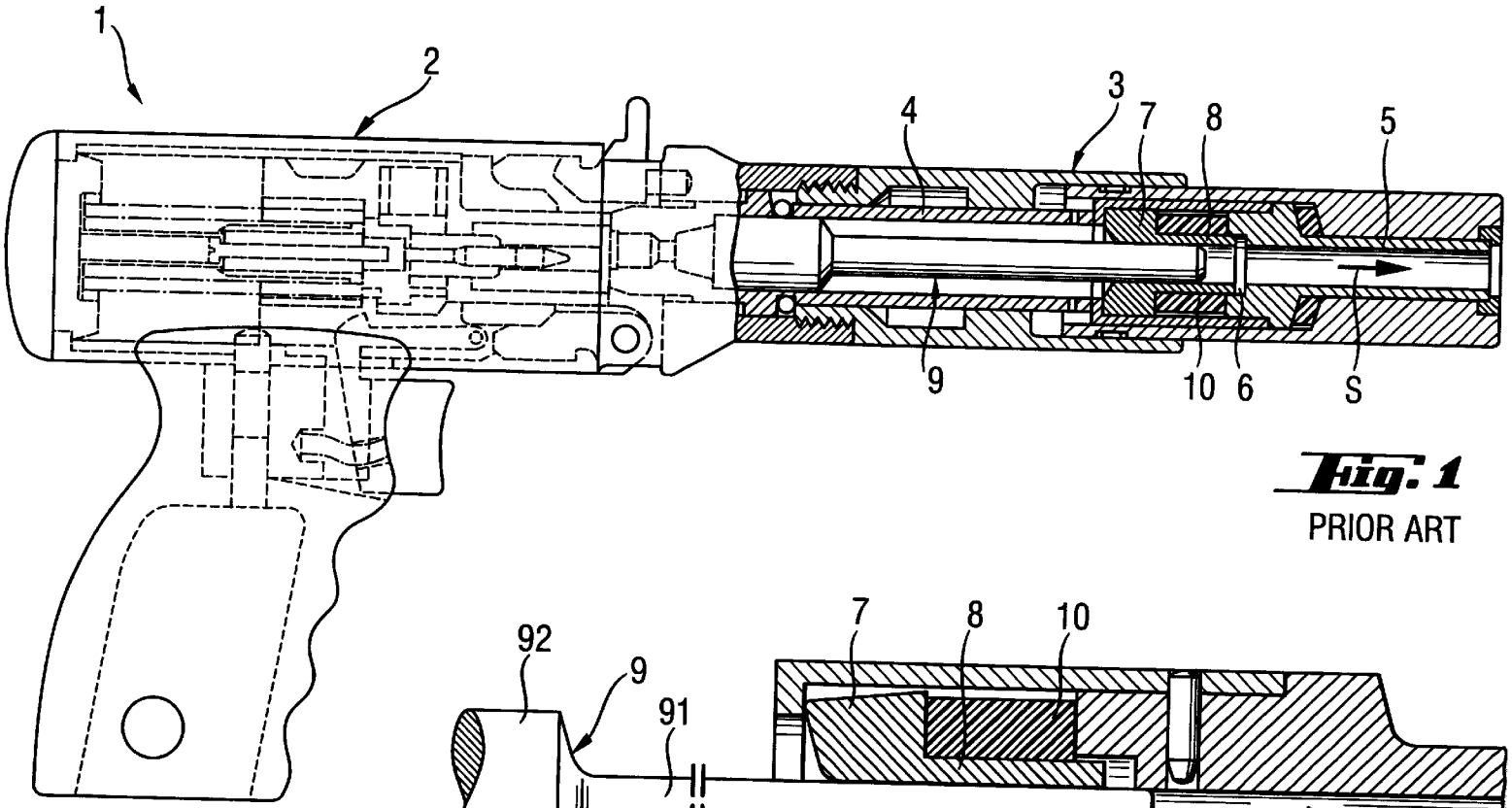
Fig. 1 PRIOR ART
FIG. 1. a side, partially cross-sectional view of a prior art bolt setting tool.
Figure 2:
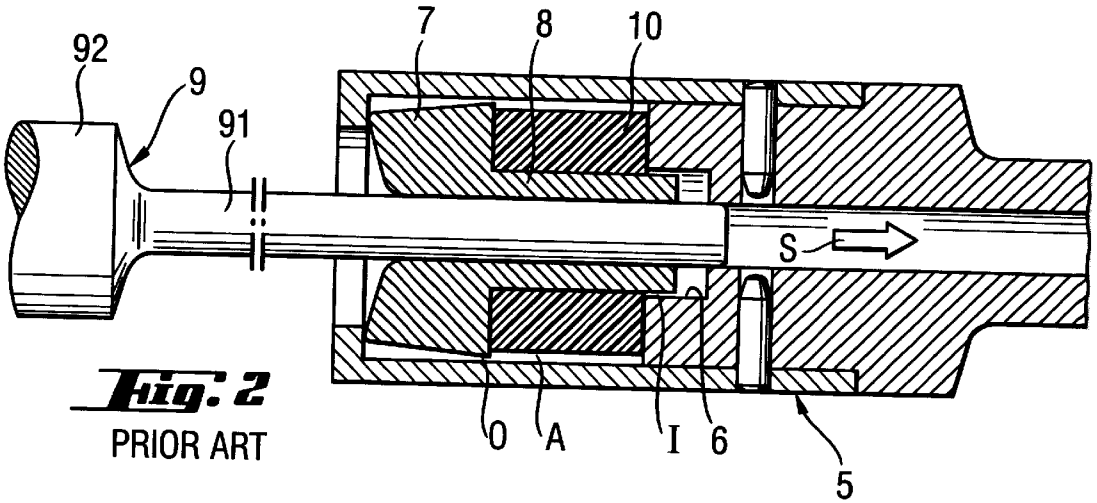
Fig. 2 PRIOR ART
FIG. 2. a detailed view of a section of the tool shown in FIG. 1 at an increase scale.

FIG. 1 shows a longitudinal view of a prior art bolt setting tool, with FIG. 2 showing a section of the tool at an increased scaled. The bolt setting tool 1 has a release mechanism 2 and a run section 3. The release mechanism is formed, e.g., as an explosive powder charge-operated device and has a conventional construction. The release mechanism can also have a different construction and be formed, e.g., as a hydraulically or pneumatically operated device. For the understanding of the invention, the construction of the release mechanism is irrelevant. The description of the run section 3 is also limited to the description of elements necessary for understanding of the present invention. The run section 3 includes a guide tube 4 for a drive piston 9 which is accelerated by the release mechanism in a direction toward the mouth of the run section 3. A bolt guide 5 adjoins the guide tube 4 in an axial direction. The bolt guide 5 is designed for guiding a bolt or the like to be driven into a constructional component. A sleeve-shaped pressure member 7 is arranged between the bolt guide 5 and the head of the drive piston 9. The pressure member 7 is supported against the bolt guide 5, with an elastic pad 10 arranged there between. The pressure member 7 has a stepped outer diameter and has an axially extending, cylindrical portion 8 having a smaller diameter than the remainder of the pressure member and projecting into a receiving chamber 6 at the entrance of the bolt guide 5.

As a result of generated, during the tool operation, excess energy, the head of the drive piston 9 impacts the pressure member 7, displacing it in the setting direction 5. The excess energy of the drive piston is absorbed by the pad 10 which becomes axially flattened, as a result. The outer diameter of the pad 10 is at least region wise somewhat smaller than the inner diameter of the receiving chamber 6. The resulting annular gap A provides, thus, for axial flattening of the pad 10 which expands radially. In order to insure a perfect displacement of the pressure member 7 relative to the bolt guide 5, a large clearance is provided between the two, movable relative to each other, elements. As a result, two narrow annular clearances O and I are formed, respectively, between the outer surface of the pressure member 7 and the bold guide 5 and between the outer surface of the projecting portion 8 and the inner wall of the receiving chamber 6. During the compression of the pad 10, these exists a danger of wedging of the edge areas of the pad 10 in the annular gaps O and I. This can result in clamping of the entire pad 10, preventing return of the pressure member 7 in its initial position. Upon the next impact of the head of the drive piston 9 on the pressure member 7, the pad 10 is not able to absorb the excess energy. This can result in the damage of the mechanical structure of the tool. The wedging also can cause an excess wear of the pad 10, resulting in a need for its early replacement.

Figure 3:
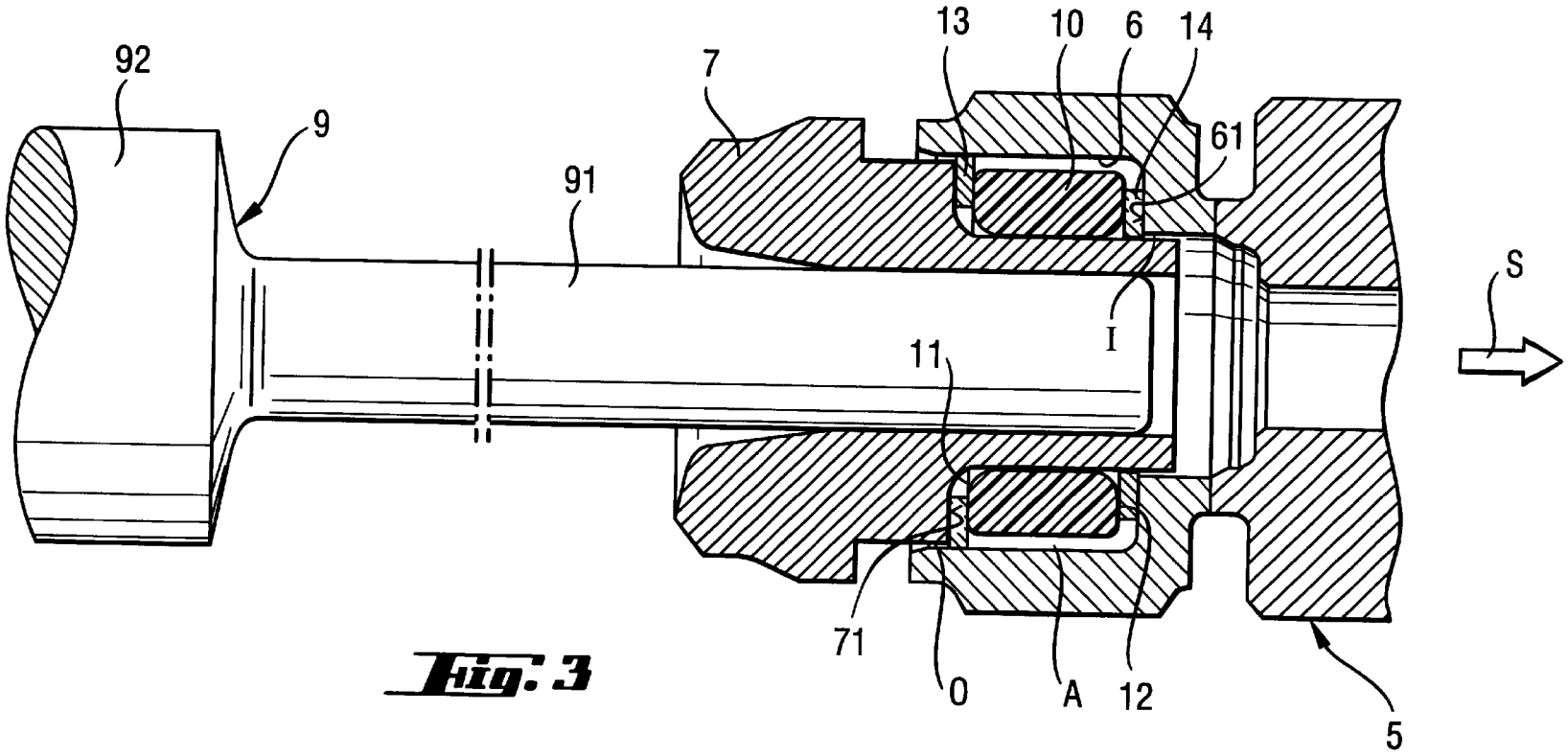
FIG. 3. a view similar to that of FIG. 2 with modifications according to the present invention.

The modifications made in the region between the head 92 of the drive piston 9 and the bolt guide 5 according to the present invention eliminate the drawbacks of the prior art bolt setting tool. For better understanding, the same components are shown in FIG. 3 as in FIGS. 1–2 and bear the same reference numerals despite their somewhat different geometrical shape. As in FIG. 2, in the embodiment shown in FIG. 3, a sleeve-shaped pressure member 7 is arranged between the head 92 of the drive piston 9 and the bolt guide 5, with a cylindrical extension 8 of the pressure member 7 extending in the setting direction S. The cylindrical extension 8 has a smaller outer diameter than the remainder of the pressure member 7 and projects into the receiving chamber 6 at the entrance of the bolt guide 5. The stem 91 of the drive piston 9 extends into the pressure member 7 and its cylindrical extension 8 and further into the receiving chamber 6 of the bolt guide 5.

The cylindrical extension 8 carries the annular pad 10 formed, preferably of a rubber elastic material. The outer diameter of the pad 10 is smaller than the inner diameter of the receiving chamber 6 of the guide member 5, forming with the inner diameter of the receiving chamber 6 an annular gap A. The pad 10, upon being flattened, expands into the annular gap A. The pad 10 can be formed of several separate elements mounted on the cylindrical extension 8. Thus, annular gaps O and I are formed between the pressure member 7 and the receiving chamber 6 and the cylindrical extension 8 and the entrance in the bolt guide 5. At both longitudinal ends of the pad 10, there are provided seal rings 13 and 14. The first seal ring 13 is provided between an annular stop surface 71 of the pressure member 7 and the end surface 19 of the pad 10 facing in a direction opposite the setting direction. The seal ring 13 is preloaded radially against the inner wall of the receiving chamber 6. The second seal ring 14 is provided between the annular stop surface 61 of the receiving chamber 6 and an end surface 12 of the pad 10 facing in the setting direction. The seal ring 14 is radially preloaded against an outer surface of the cylindrical extension 8. The radially preloaded seal rings 13 and 14 form a closedown against the annular gaps O and I, preventing wedging of the pad 10. The seal rings are formed as resilient rings and can be formed of several resilient disc-shaped rings and provide outer or inner preload. During the operation, the outer or inner preload actions are reinforced by generated high inner pressures acting on the inner and outer circumferential surfaces of the seal rings 13 and 14, respectively. The seal rings 13 and 14 can be formed as single disc-shaped sealing ring that are placed on the cylindrical extension 8 in front and behind the pad 10. According to an alternative embodiment, the seals can be formed integrally with the pad 10 by being glued thereto or by vulcanization, with the so-formed integral element being placed on the cylindrical projection. The seal rings 13 and 14 are formed, e.g., of a spring steel and are provided along their circumference with a split.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A bolt setting tool for driving bolts and similar fastening elements into constructional components, the bold setting tool comprising a bolt guide (5) having a receiving chamber (6); an axially displaceable drive piston (9) having a head (92); a sleeve-shaped pressure member (7) arranged between the head (92) of the drive piston (9) and the bolt guide (5) and having a cylindrical extension (8) extending in a setting direction (S) and projecting into the receiving chamber (6) of the bolt guide (5), the cylindrical extension (8) having a smaller diameter than a remainder of the pressure member (7); and an elastic pad (10) mounted on the cylindrical extension (8) of the pressure member (7) and extending between first and second seal rings (13, 14), the first seal ring (13) arranged between a ring-shaped stop surface (71) of the pressure member (7) and an end surface (11) of the pad (10) facing in a direction opposite to the setting direction and being radially resiliently preloaded against an inner wall of the receiving chamber (6) of the bolt guide (5), and the second seal ring (14) being arranged between a ring-shaped stop surface (61) formed in the receiving chamber (6) and an end surface (12) of the pad (10) facing in the setting direction (S), and being radially resiliently preloaded against an outer surface of the cylindrical extension (8) of the pressure member (2).

2. A bolt setting tool as set forth in claim 1, where in each of the seal rings (13,14) is formed of a plurality of separate disc-shaped sealing elements.

3. A bolt setting tool as set forth in claim 1, wherein the seal rings (13,14) are formed of a spring steel.

4. A bolt setting tool as set forth in claim 1, wherein the first seal ring (13) is fastened to one of the stop surface (71) of the pressure member (7) and the end surface (11) of the pad (10) facing in a direction opposite the setting direction (S), and wherein the second seal ring (14) is fastened to one of the stop surface (66) of the receiving chamber (6) and the end surface (12) of the pad (10) facing in the setting direction (S).

5. A bolt setting tool as set forth in claim 4, wherein the seal rings (13,14) are fixedly connected with respective end surfaces (11, 12) of the pad (10).

6. A bolt setting tool as set forth in claim 5, wherein the seal rings (13,14) are connected with the respective end surfaces (11, 12) of the pad (10) by one of gluing and vulcanization.

7. A bolt setting tool as set forth in claim 1, wherein the pad (10) is formed as a one-piece sleeve-shaped member and has, at least region wise, an outer diameter which is smaller than an inner diameter of the receiving chamber (6) at an entrance of the bolt guide (5).

* * * * *